US008532913B2

(12) United States Patent
Hirai et al.

(10) Patent No.: US 8,532,913 B2
(45) Date of Patent: Sep. 10, 2013

(54) START-UP CONTROL SYSTEM FOR INTERNAL COMBUSTION ENGINE

(75) Inventors: Takuya Hirai, Susono (JP); Yoshinori Futonagane, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/381,833

(22) PCT Filed: Jul. 9, 2009

(86) PCT No.: PCT/JP2009/062537

§ 371 (c)(1),
(2), (4) Date: Dec. 30, 2011

(87) PCT Pub. No.: WO2011/004484

PCT Pub. Date: Jan. 13, 2011

(65) Prior Publication Data

US 2012/0101708 A1 Apr. 26, 2012

(51) Int. Cl.
*F02D 41/06* (2006.01)
*F02D 41/14* (2006.01)

(52) U.S. Cl.
USPC ..... 701/113; 123/179.16

(58) Field of Classification Search
USPC ..... 701/103, 104, 102, 105; 123/179.3, 123/179.16, 179.1, 179.14, 687, 339.19
See application file for complete search history.

(56) References Cited

U.S. PATENT DOCUMENTS

| | | | | |
|---|---|---|---|---|
| 6,776,033 | B2 | 8/2004 | Hori et al. | |
| 7,269,499 | B2 | 9/2007 | Murakami et al. | |
| 7,949,461 | B2 | 5/2011 | Takahashi | |
| 2004/0000190 | A1 | 1/2004 | Hori et al. | |
| 2005/0228575 | A1 | 10/2005 | Murakami et al. | |
| 2008/0091328 | A1 * | 4/2008 | Tabata et al. | 701/102 |
| 2008/0092841 | A1 | 4/2008 | Takahashi | |
| 2010/0204902 | A1 * | 8/2010 | Kuroki et al. | 701/103 |

FOREIGN PATENT DOCUMENTS

| | | |
|---|---|---|
| DE | 10 2004 059 641 A1 | 6/2006 |
| JP | A-60-240875 | 11/1985 |
| JP | B2-06-34001 | 5/1994 |
| JP | A-2005-299445 | 10/2005 |
| JP | A-2006-194234 | 7/2006 |
| JP | B2-3794485 | 7/2006 |
| JP | B2-3965577 | 8/2007 |

OTHER PUBLICATIONS

Aug. 11, 2009 International Search Report issued in International Patent Application No. PCT/JP2009/062537.

* cited by examiner

*Primary Examiner* — Mahmoud Gimie
(74) *Attorney, Agent, or Firm* — Oliff & Berridge, PLC

(57) ABSTRACT

An object is to provide a technology that enables starting of fuel injection under a condition that allows injected fuel to ignite and burn at the time of start-up of an internal combustion engine. To achieve the object, a start-up control system for an internal combustion engine according to the invention estimates, at the time of start-up of the internal combustion engine, the amount of rotation of a crankshaft in a period since the start of cranking until a crank position sensor outputs an effective pulse signal and determines, based on the stopping position of the crankshaft specified by the value thus estimated, whether or not fuel is to be injected at the first fuel injection time.

11 Claims, 10 Drawing Sheets

START-UP CONTROL SYSTEM FOR INTERNAL COMBUSTION ENGINE

TECHNICAL FIELD

The present invention relates to a start-up control system for an internal combustion engine, in particular to a system that controls fuel injection at the time of start-up of an internal combustion engine.

BACKGROUND ART

At the time of start-up of an internal combustion engine having a crankshaft that rotates a plurality of times per one cycle, it is necessary to determine on which stroke each cylinder is in order to set fuel injection timing and ignition timing for that cylinder. Moreover, in order to start the internal combustion engine in a short time, it is necessary to quickly determine the stroke in the cycle of the cylinder.

To meet the above need, Patent Document 1 teaches to set a provisional cylinder discrimination period based on a signal generated by a crank position sensor and, if a cylinder discrimination signal is detected in the provisional cylinder discrimination period, to set the provisional cylinder discrimination period as an actual cylinder discrimination period to determine the stroke in the cycle of the cylinder.

Patent Document 2 teaches to memorize the stopping position of the crankshaft when the operation of an internal combustion engine stops and to estimate the rotational position of the crankshaft at the time of restart of the internal combustion engine based on the memorized stopping position.

Patent Document 3 teaches to disable the sensing by a crank position sensor in a period during which a large voltage fall occurs due to the operation of a starter motor at the time of start-up of the internal combustion engine.

Patent Document 4 teaches to disable the sensing by a crank position sensor during a predetermined period of time since the commencement of the start-up of an internal combustion engine and to detect the top dead center on the compression stroke based on the stopping position of the crankshaft and a rotational change of the crankshaft.

PRIOR ART DOCUMENT

Patent Document

Patent Document 1: Japanese Patent No. 3794485
Patent Document 2; Japanese Patent Application Laid-Open No. 60-240875
Patent Document 3: Japanese Examined Patent Publication No. 06-34001
Patent Document 4: Japanese Patent No. 3965577

DISCLOSURE OF THE INVENTION

Problem to be Solved by the Invention

If the stroke in the cycle of a cylinder is determined early, the time of first fuel injection will come early. If so, there is a possibility that fuel injected at the time of first fuel injection might not ignite or burn.

For example, in the case of a cylinder in which the cranking is started from the middle of the compression stroke, if the time for first fuel injection comes in the same cycle, there is a possibility that the pressure and temperature in the cylinder might not reach a range of values suitable for combustion of fuel and that the ignition and combustion of injected fuel might be unsatisfactory.

The present invention has been made in view of the above-described situations and an object thereof is to provide a technology that enables starting of fuel injection under a condition that allows injected fuel to ignite and burn at the time of start-up of an internal combustion engine.

Means for Solving the Problem

In the present invention, the following means is adopted to solve the above described problem. In a start-up control system for an internal combustion engine according to the present invention, at the time of start-up of the internal combustion engine, the amount of rotation of the crankshaft during the period since the start of cranking of the internal combustion engine until the crank position sensor outputs an effective pulse signal is estimated, and it is determined, based on the stopping position of the crankshaft specified by the amount thus estimated, whether or not fuel is to be injected at the first fuel injection time.

Specifically, a start-up control system for an internal combustion engine according to the present invention comprises:

a cranking mechanism that cranks the internal combustion engine at the time of start-up of the internal combustion engine;

setting unit for determining the rotational position of a crankshaft while the internal combustion engine is cranked by said cranking mechanism and for setting a fuel injection start time based on a result of the determination;

counting unit for counting the number of pulses output from a crank position sensor since the start of cranking of the internal combustion engine by said cranking mechanism;

estimation unit for estimating the amount of rotation of the crankshaft in a period since the start of cranking of the internal combustion engine until the crank position sensor outputs an effective pulse signal; and control unit that enables injection of fuel at the fuel injection start time set by said setting unit on condition that the stopping position of the crankshaft determined by the count counted by said counting unit and the value estimated by the estimation unit is before (i.e. advanced relative to) a predetermined position.

The internal combustion engine mentioned here is an internal combustion engine that goes through four or more strokes in one cycle of operation. The fuel injection start time is the time of fuel injection that comes earliest after the determination of the rotational position of the crankshaft.

For example, in the case of an internal combustion engine that goes through four strokes in one cycle of operation (i.e. four-stroke cycle internal combustion engine), the crankshaft rotates two times (rotates by 720 degrees) in one cycle. Therefore, in order to set fuel injection timing, it is necessary to determine at which rotational position (or angle) in the 0 to 720 angle range the crankshaft is situated, in other words, which stroke among the four strokes the cylinder is on.

It is difficult to make the above determination based only on a signal generated by the crank position sensor. For instance, even if it is determined from the signal generated by the crank position sensor that the piston is located at the top dead center, it is not possible to determine whether this top dead center is the top dead center on the compression stroke or the top dead center on the exhaust stroke.

There is a known method of determining at which rotational position in the 0 to 720 degree angle range the crankshaft is situated (such a determination will be referred to as the "cylinder discrimination" hereinafter) during the cranking of an internal combustion engine, using a crank position sensor and a cylinder discrimination sensor in combination.

In recent years, it is desired that the cylinder discrimination be finished early. However, if the cylinder discrimination is finished early, fuel injected at the first fuel injection time (fuel injection start time) might not ignite or burn in some cases. In the following description, the cylinder for which fuel injection is performed at the first (or earliest) time of fuel injection will be referred to as the "first injection cylinder".

For example, in cases where cranking is started from the middle of the compression stroke in the first injection cylinder, if the fuel injection start time comes in the same cycle, there is a possibility that the temperature and pressure in the first injection cylinder will not reach a range suitable for fuel combustion (which will be hereinafter referred to as the "combustible range"). In consequence, there might be cases in which the fuel injected at the fuel injection start time does not ignite or burn.

In order to determine whether or not fuel injected into the first injection cylinder can ignite and burn, it is necessary to specifically determine the stopping position of the crankshaft (i.e. the position of the crankshaft at the time when the cranking is started). Specifically, in order to determine whether or not fuel injected into the first injection cylinder can ignite and burn, it is necessary to determine whether or not the stopping position of the crankshaft is before a specific position.

The aforementioned specific position corresponds to the compression stroke beginning position in the first injection cylinder. The compression stroke beginning position is the stopping position of the crankshaft that meets a condition that the in-cylinder temperature and in-cylinder pressure at the top dead center in the compression stroke (the temperature and pressure at the compression end) in the first injection cylinder reach the combustible range. Examples of the stopping position of the crankshaft that meets this condition include the bottom dead center in the compression stroke in the first injection cylinder and the intake valve closing position (that is, the position of the crankshaft at the time when the intake valve closes). However, the compression stroke beginning position may be set at a position after (retarded relative to) the bottom dead center in the compression stroke in the first injection cylinder or the intake valve closing position so long as the above-described condition is met.

The temperature and the pressure at the compression end in the first injection cylinder vary with the ambient air temperature (more appropriately, with the in-cylinder temperature) at the time when the cranking is started. Therefore, the compression stroke beginning position may be changed in relation to the ambient air temperature.

A method of specifically determining the stopping position of the crankshaft may be counting the total number of signal pulses (which will be hereinafter referred to as the "total number of pulses") output from the crank position sensor during a period since the start of the cranking until a certain time and calculating the stopping position of the crankshaft backward based on the rotational position of the crankshaft at the certain time and the total number of pulses.

The aforementioned certain time may be any time in a period since the completion of the cylinder discrimination (since the time when the rotational position of the crankshaft is specifically determined) until the fuel injection start time. However, it is preferred that the determination as to whether or not fuel injection is to be performed at the fuel injection start time be made as early as possible. Therefore, it is preferred that the aforementioned certain time be the time at which the cylinder discrimination is completed.

The specific determination of the stopping position of the crankshaft in the above-described manner enables the determination of whether or not injected fuel can ignite and burn if fuel is injected at the fuel injection start time.

However, magnetic pickup (MPU) sensors used in the crank position sensor and the cylinder discrimination sensor characteristically suffer from deterioration in sensing accuracy when the rotation speed of the crankshaft is lower than a certain rotation speed.

Therefore, the crank position sensor will not output an effective pulse signal in the period since the start of the cranking until the rotation speed of the crankshaft becomes equal to or higher than a certain speed. In consequence, the count counted by the counting unit (which will be hereinafter referred to as the "total pulse count") will differ from the total number of pulses (which is the number of pulses that correlates with the actual amount of rotation of the crankshaft in the period since the start of cranking until a specific time). The "certain rotation speed" mentioned above is the lowest rotation speed at which the crank position sensor can output an effective pulse signal (which will be hereinafter referred to as the "lowest rotation speed").

In view of the above, the start-up control system for an internal combustion engine according to the present invention is provided with the estimation unit for estimating the amount of rotation (which will be hereinafter referred to as the "not-sensed rotation amount) of the crankshaft in a period (which will be hereinafter referred to as the "non-sensing period") since the start of cranking of the internal combustion engine until the rotation speed of the crankshaft becomes equal to or higher than the lowest rotation speed and the control unit that enables injection of fuel at the fuel injection start time on condition that the stopping position of the crankshaft specifically determined by the value estimated by the estimation unit and the total pulse count is before the compression stroke beginning position of the first injection cylinder.

According to the above-described invention, in cases where the cranking starts from the middle of the compression stroke of the first injection cylinder and the fuel injection start time comes in the same cycle, fuel injection at the fuel injection start time is disabled. On the other hand, in cases where the cranking starts before the beginning of the compression stroke in the first injection cylinder and the fuel injection start time comes in the same cycle, fuel injection for the first injection cylinder is enabled. In cases where fuel injection at the fuel injection start time is disabled, fuel injection may be started for the cylinder (which will be hereinafter referred to as the "second injection cylinder") for which the time for fuel injection comes immediately after the first injection cylinder.

With the start-up control system for an internal combustion engine described above, a situation in which fuel injection is started at the time of start-up of the internal combustion engine under a condition in which injected fuel is hard to burn can be avoided. In other words, with the start-up control system for an internal combustion engine according to the present invention, at the time of start-up of the internal combustion engine, fuel injection can be started under a condition in which injected fuel can ignite and burn. In consequence, it is possible to prevent an increase in exhaust emissions and an increase in fuel consumption at the time of start-up of the internal combustion engine.

In the system according to the present invention, the control unit may correct the total pulse count counted by the counting unit based on the value estimated by the estimation unit, and if the total pulse count after correction is not smaller than a predetermined reference value, it may be determined that the stopping position of the crankshaft is before the compression stroke beginning position. The aforementioned predetermined reference value is the total number of pulses in the case where the stopping position of the crankshaft is at the compression stroke beginning position in the first injection cylinder or a value obtained by adding a safety margin to the total number of pulses.

With this feature of the invention, in cases where the cranking is started from the middle of the compression stroke in the first injection cylinder and the fuel injection start time comes in the same cycle, the total pulse count after correction will be smaller than the reference value. On the other hand, in cases where the cranking is started before the beginning of the compression stroke in the first injection cylinder and the fuel injection start time comes in the same cycle, the total pulse count after correction will be equal to or larger than the reference value.

Therefore, in cases where the cranking is started from the middle of the compression stroke in the first injection cylinder and the fuel injection start time comes in the same cycle, fuel injection for the first injection cylinder is disabled. On the other hand, in cases where the cranking is started before the beginning of the compression stroke in the first injection cylinder and the fuel injection start time comes in the same cycle, fuel injection for the first injection cylinder is enabled.

In the system according to the present invention, the not-sensed rotation amount may be obtained in advance by an adaptation process based on an experiment etc. The not-sensed rotation amount might change depending on the environment in which the internal combustion engine is used and/or the state of charge of a battery.

For instance, the friction in the internal combustion engine will be higher and the output of the battery will be lower when the ambient air temperature is low than when the ambient air temperature is high. Therefore, the not-sensed rotation amount will be larger when the ambient air temperature is low than when the ambient air temperature is high.

The output of the battery will be lower when the state of charge (SOC) of the battery is low than when the SOC is high. Consequently, the not-sensed rotation amount will be larger when the SOC is low than when the SOC is high.

In view of the above, a not-sensed rotation amount (which will be hereinafter referred to as the "standard value") at the time when the ambient air temperature is in a normal temperature range and the SOC of the battery is not lower than a specific value may be obtained in advance by an experiment, and the estimation unit may estimate the not-sensed rotation amount by correcting the standard value in relation to the ambient air temperature and/or the SOC.

Then, the estimation unit may correct the standard value in such a way that the not-sensed rotation amount is made larger when the ambient air temperature at the time of starting the cranking is low than when it is high. The estimation unit may also correct the standard value in such a way that the not-sensed rotation amount is made larger when the SOC at the time of starting the cranking is low than when it is high.

In the start-up control system for an internal combustion engine according to the present invention, the correction of the aforementioned standard value may be replaced by the correction of compression stroke beginning position or the correction of the reference value. For example, the correction of the standard value in relation to the ambient air temperature and/or the SOC by the estimation unit may be replaced by the correction of the compression stroke beginning position or the reference value in relation to the ambient air temperature and/or the SOC by the control unit.

If this is the case, the control unit may correct the compression stroke beginning position or the reference value in such a way that the compression stroke beginning position is more retarded or the reference value is made smaller when the ambient air temperature is low than when the ambient air temperature is high. Similarly, the control unit may correct the compression stroke beginning position or the reference value in such a way that the compression stroke beginning position is more retarded or the reference value is made smaller when the SOC is low than when the SOC is high.

It is considered that the rotation speed (degree of increase in the rotation) of the crankshaft after the rotation speed of the crankshaft becomes equal to or higher than the lowest rotation speed correlates with the friction in the internal combustion engine and the SOC of the battery. Specifically, the aforementioned rotation speed is higher when the friction in the internal combustion engine is low than when the friction is high. The aforementioned rotation speed is higher when the SOC of the battery is high than when the SOC is low.

Therefore, the standard value, the compression stroke beginning position and the reference value may be corrected in relation to the rotation speed of the crankshaft after the rotation speed of the crankshaft becomes equal to or higher than the lowest rotation speed. The rotation speed of the crankshaft after the rotation speed of the crankshaft becomes equal to or higher than the lowest rotation speed can be calculated based on the interval of signal pulses output by the crank position sensor.

In cases where an electric cranking device such as a motor or a motor generator is used as the cranking mechanism in the present invention, the estimation unit may estimate the not-sensed rotation amount based on the voltage and/or current of the battery during the non-sensing period.

The current of the battery during the cranking of the internal combustion engine tends to increase at the time when the crankshaft passes the top dead center on the compression stroke. On the other hand, the voltage of the battery during the cranking of the internal combustion engine tends to decrease at the time when the crankshaft passes the top dead center on the compression stroke.

Therefore, it is possible to determine whether or not the crankshaft passes the top dead center on the compression stroke of a cylinder other than the first injection cylinder (or the bottom dead center on the compression stroke of the first injection cylinder) before it passes the top dead center on the compression stroke of the first injection cylinder by monitoring the current or voltage of the battery during the non-sensing period.

If it is determined that the crankshaft passes the top dead center on the compression stroke of a cylinder other than the first injection cylinder before it passes the top dead center on the compression stroke of the first injection cylinder, the estimation unit may give an estimated value of the not-sensed rotation amount larger than a predetermined value. On the other hand, if it is determined that the crankshaft does not pass the top dead center on the compression stroke of a cylinder other than the first injection cylinder before it passes the top dead center on the compression stroke of the first injection cylinder, the estimation unit may give an estimated value of the not-sensed rotation amount smaller than the predetermined value.

The predetermined value mentioned above is equal to the amount of rotation of the crankshaft during the period since the start of the cranking until the completion of the cylinder discrimination in the case where the stopping position of the crankshaft is at the compression stroke beginning position of the first injection cylinder.

Internal combustion engines to which the present invention can suitably applied are those in which fuel injection is performed during the compression stroke of each cylinder. Examples of such cylinders include a spark-ignition internal combustion engine equipped with fuel injection valves that inject fuel into cylinders and a compression-ignition internal combustion engine.

Advantageous Effect of the Invention

According to the present invention, fuel injection can be started at the time of start-up of an internal combustion engine under a condition that allows injected fuel to ignite and burn.

THE BEST MODE FOR CARRYING OUT THE INVENTION

In the following, specific embodiments of the present invention will be described with reference to the drawings. The dimensions, materials, shapes and relative arrangements etc. of the components that will be described in connection with the embodiments are not intended to limit the technical scope of the present invention only to them, unless particularly stated.

Embodiment 1

Figure 1:
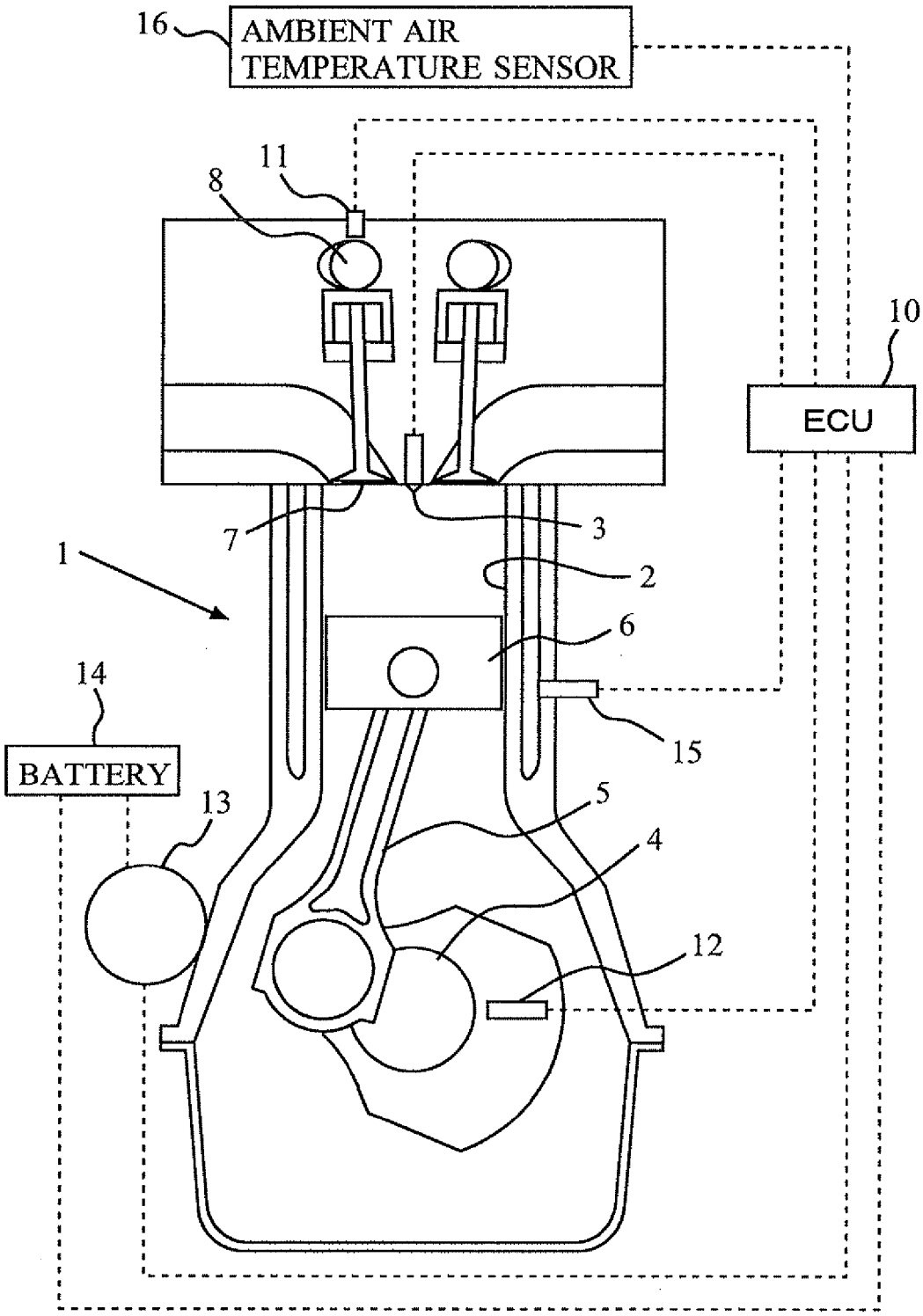
FIG. 1 is a diagram showing the basic configuration of an internal combustion engine to which the present invention is applied.

A first embodiment of the present invention will be described firstly with reference to FIGS. 1 to 7. FIG. 1 is a diagram showing the basic configuration of an internal combustion engine to which the present invention is applied.

The internal combustion engine 1 shown in FIG. 1 is a four-stroke-cycle, compression-ignition internal combustion engine (diesel engine) having four cylinders 2. In FIG. 1, only one cylinder 2 among the four cylinders 2 is illustrated. It is assumed in this internal combustion engine 1 that the firing in the cylinders proceeds in the order of the number one cylinder, the number three cylinder, the number four cylinder, and the number two cylinder.

Each cylinder 2 in the internal combustion engine 1 is provided with a fuel injection valve 3 for injecting fuel into the cylinder. A piston 6 is slidably provided in each cylinder. The piston 6 is connected to a crankshaft 4 by means of a connecting rod 5.

The internal combustion engine 1 has an intake valve 7 for opening/closing the open end of the intake port that faces the interior of the cylinder 2. The intake valve 7 is driven by an intake cam shaft 8 to open/close. The intake cam shaft 8 is linked with the crankshaft 4 by means of a belt or chain to rotate once while the crankshaft 4 rotates twice.

A cam position sensor 11 that senses the rotational position of the intake cam shaft 8 is provided for the intake cam shaft 8. On the other hand, a crank position sensor 12 that senses the rotational position of the crankshaft 4 is provided for the crank shaft 4. In this embodiment, the cam position sensor 11 corresponds to the cylinder discrimination sensor according to the present invention.

A starter motor 13 is attached to the internal combustion engine 1. The starter motor 13 is an electric motor for rotationally driving the crankshaft 4 (cranking) utilizing electrical energy stored in a battery 14. The starter motor 13 corresponds to the cranking mechanism according to the present invention.

An electric control unit (ECU) 10 for controlling the operation state of the internal combustion engine 1 is annexed to the internal combustion engine 1 having the above described structure. The ECU 10 is connected with the battery 14, a water temperature sensor 15 and an ambient air temperature sensor 16 etc. The water temperature sensor is a sensor for measuring the temperature of cooling water circulating in the internal combustion engine. The ambient air temperature sensor 16 is a sensor for measuring the temperature of the ambient air. This sensor may also measure the intake air temperature.

The ECU 10 controls the fuel injection valve 3, the starter motor 13 and other components based on signals output from the above-mentioned various sensors and the state of charge (SOC) of the battery 14. For example, at the time of start-up of the internal combustion engine 1, the ECU 10 causes the starter motor 13 to operate, thereby cranking the internal combustion engine 1 and starts fuel injection to the cylinders 2.

It is necessary for the ECU 10 to determine the stroke position in each cylinder 2 upon starting fuel injection to each cylinder 2. Specifically, it is necessary for the ECU 10 to determine at which rotational position in the range from 0 to 720 CA degrees the crankshaft 4 is situated (cylinder discrimination) upon starting fuel injection to each cylinder.

Therefore, the ECU 10 performs the cylinder discrimination based on a signal from the crank position sensor 12 and a signal from the cam position sensor 11. Exemplary configurations of the crank position sensor 12 and the cam position sensor 11 will be described with reference to FIGS. 2 and 3.

Figure 2:
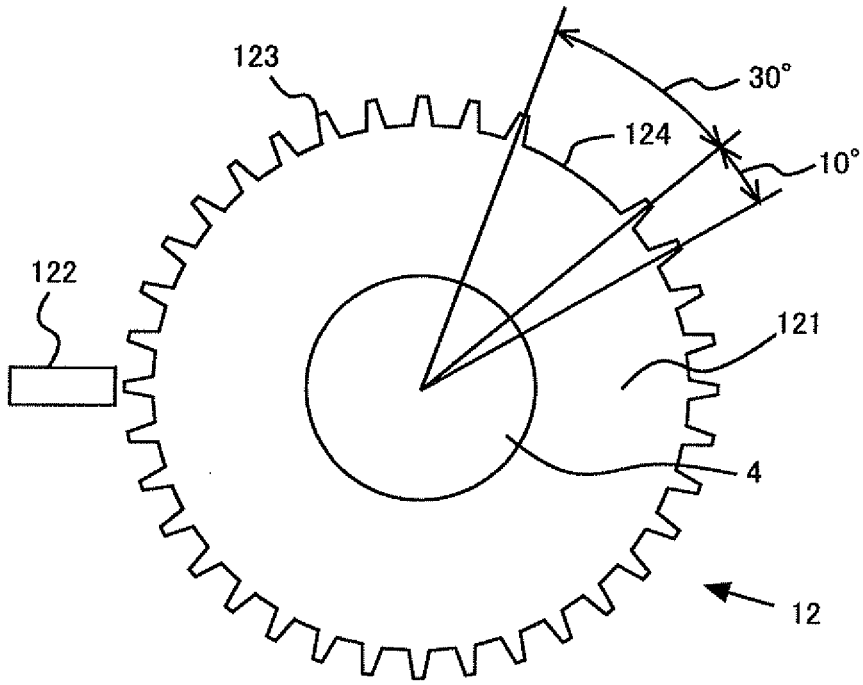
FIG. 2 schematically shows the structure of a crank position sensor.

First, the configuration of the crank position sensor 12 will be described with reference to FIG. 2. The crank position sensor 12 shown in FIG. 2 is a magnetic pickup (MPU) sensor having a rotor 121 that rotates integrally with the crankshaft 4 and a pickup 122 provided in the vicinity of the rotor 121.

The rotor 121 is a disk-like member made of a ferromagnetic material. The rotor has teeth 123 provided along its outer circumference at regular crank angles. The rotor 121 also has a tooth-free portion 124 in which not tooth is provided in a portion of its outer circumference. In the exemplary configuration shown in FIG. 2, the tooth 123 is provided at every 10 CA degrees. The tooth-free portion 124 lacks two teeth 123 to have a width corresponding to 30 CA degrees.

With the crank position sensor 12 having the above-described configuration, the gap between the pickup 122 and the outer periphery of the rotor 121 becomes small as a tooth 123 of the rotor 121 passes near the pickup 122. In consequence, as a tooth 123 of the rotor 121 passes near the pickup 122, an electromotive force is generated in the pickup 122 by electromagnetic induction. Consequently, the crank position sensor 12 generates a voltage pulse at every 10 CA degree rotation of the crankshaft 4.

On the other hand, while the tooth-free portion 124 of the rotor 121 passes near the pickup 122, the interval of the generation of the voltage pulse becomes longer. Therefore, it can be determined that the tooth-free portion 124 passes near the pickup 122 at the time when the pulse generation interval in the crank position sensor 12 becomes longer. In the following, the signal that is generated at the time when the tooth-free portion 124 passes near the pickup 122 will be referred to as the "datum signal" hereinafter.

The crank position sensor 12 in this embodiment is configured in such a way that the tooth-free portion 124 passes near the pickup 122 at the time when the rotational position of the crankshaft 4 is at a position of 90 CA degrees before the top dead center of the number one and four cylinders. Consequently, the aforementioned datum signal is generated at the time when the crankshaft 4 is at a position of 90 CA degrees before the top dead center of the number one and four cylinders.

Secondly, the configuration of the cam position sensor 11 will be described with reference to FIG. 3. The cam position sensor 11 shown in FIG. 3 is a magnetic pickup (MPU) sensor having a rotor 111 that rotates integrally with the intake cam shaft 8 and a pickup 112 provided in the vicinity of the rotor 111.

Figure 3:
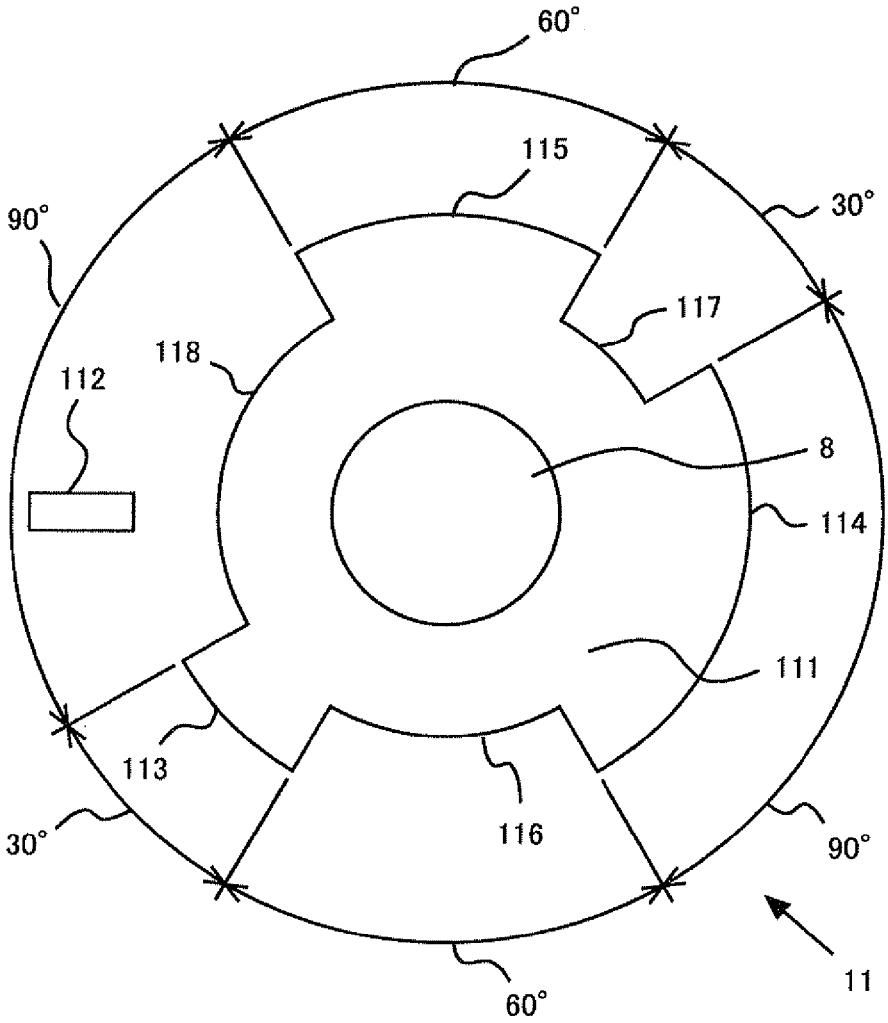
FIG. 3 schematically shows the structure of a cam position sensor.

In the exemplary configuration shown in FIG. 3, the rotor 111 has three teeth 113, 114, 115 provided on its outer circumference. The teeth 113, 114, 115 have widths (or angles about the rotational axis) different from each other. The intervals for angles about the rotational axis) of the teeth 113, 114, 115 along the rotational direction of the rotor 111 are also different from each other.

Specifically, the tooth 113 has a width corresponding to an angle of 30 degrees about the rotational axis, the tooth 114 has a width corresponding to an angle of 90 degrees about the rotational axis, and the tooth 115 has a width corresponding to an angle of 60 degrees about the rotational axis. Between the tooth 113 and the tooth 114 is provided a tooth-free portion 116 having a width corresponding to an angle of 60 degrees about the rotational axis. Between the tooth 115 and the tooth 116 is provided a tooth-free portion 117 having a width corresponding to an angle of 30 degrees about the rotational axis. Between the tooth 115 and the tooth 113 is provided a tooth-free portion 118 having a width corresponding to an angle of 90 degrees about the rotational axis.

In the cam position sensor 11 having the above-described configuration, voltage pulses are generated as the teeth 113, 114, 115 pass near the pickup 12. The cam position sensor 11 in this embodiment is configured in such a way that the boundary between the tooth 114 and the tooth-free portion 116 passes near the pickup 112 at the time when the crankshaft 4 is at a position of 90 CA degrees before the top dead center on the compression stroke of the number two cylinder. In other words, the cam position sensor 11 in this embodiment is configured in such a way that the boundary between the tooth-free portion 117 and the tooth 115 passes near the pickup 112 at the time when the crankshaft 4 is at a position of 90 CA degrees before the top dead center on the compression stroke of the number three cylinder.

Figure 4:
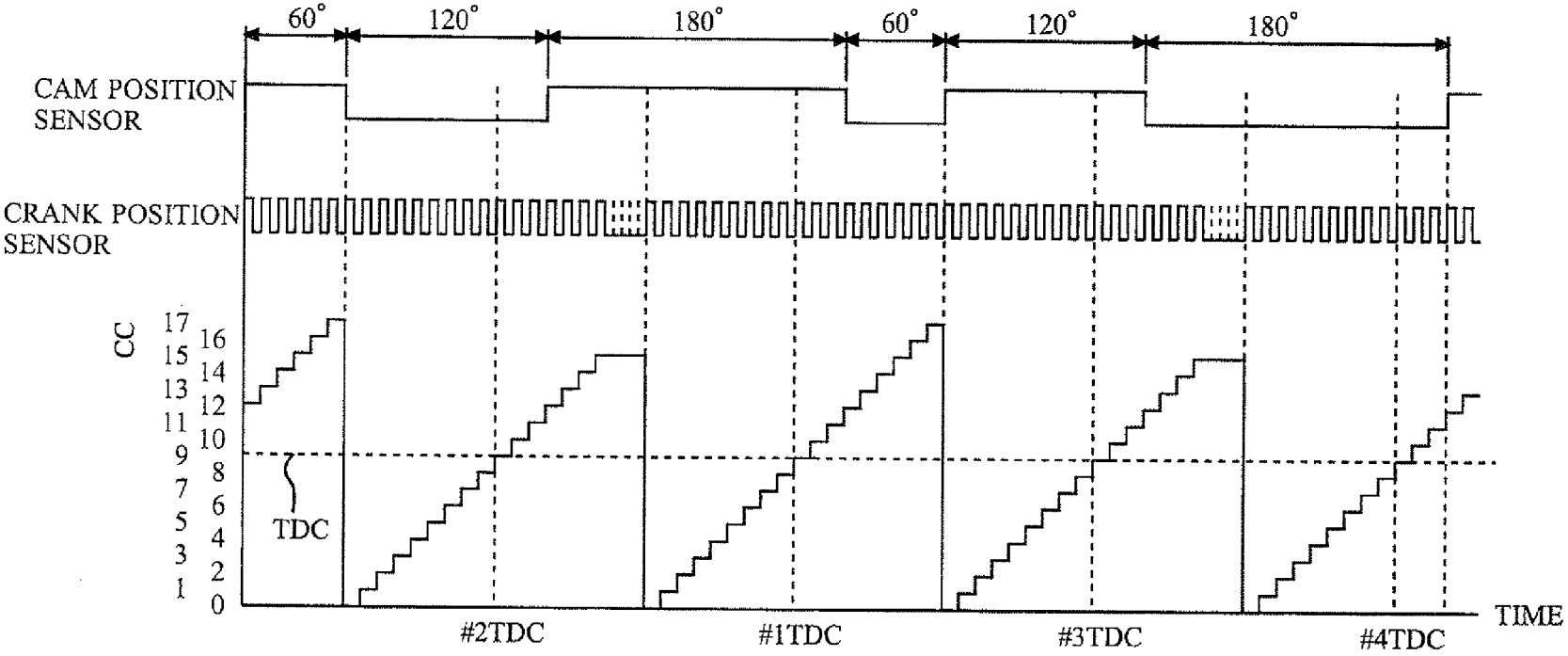
FIG. 4 shows the change in the signals output from the crank position sensor and the cam position sensor and the count of a crank counter over time.

FIG. 4 shows the change in the signals output from the crank position sensor 12 and the cam position sensor 11 configured as above and the count of a crank counter CC over time. The crank counter CC is a counter for counting the number of voltage pulses generated by the crank position sensor 12. The crank counter CC is reset to "0" (zero) at the time when the crank shaft 4 is at a position of 90 CA degrees before the top dead center of any cylinder 2. Since the crank position sensor 12 in this embodiment generates a voltage pulse at every 10 CA degree rotation, the count value of the crank position counter CC will be "9" at the time when the crankshaft 4 comes to the top dead center of any one of the cylinders 2.

In the case shown in FIG. 4, the angle about the rotational axis measured by the cam position sensor 11 is expressed by the equivalent rotational angle (CA degrees) of the crankshaft 4. In FIG. 4, "#1TDC", "#2TDC", "#3TDC" and "#4TDC" represent the top dead center on the compression stroke of the number one, two, three and four cylinders respectively.

In FIG. 4, at the time when the crankshaft 4 is at a position of 90 CA degrees before the top dead center on the compression stroke of the number one cylinder (i.e. at a position of 90 CA degrees before the exhaust top dead center of the number four cylinder), the tooth 114 of the rotor 121 of the cam position sensor 11 passes near the pickup 112. On the other hand, at the time when the crankshaft 4 is at a position of 90 CA degrees before the top dead center on the compression stroke of the number four cylinder (i.e. at a position of 90 CA degrees before the exhaust top dead center of the number one cylinder), the tooth-free portion 118 of the rotor 121 of the cam position sensor 11 passes near the pickup 112.

Therefore, the ECU 10 can determine whether the crankshaft 4 is at a position of 90 CA degrees before the top dead center on the compression stroke of the number one cylinder or at a position of 90 CA degrees before the top dead center on the compression stroke of the number four cylinder, by referring to the signal (cylinder discrimination signal) of the cam position sensor 11 at the time when the datum signal is generated by the crank position sensor 12. In other words, the ECU 10 can specifically determine at which rotational position in the 0-720 CA degree range the crankshaft 4 is situated based on the signals of the crank position sensor 12 and the cam position sensor 11.

By performing the cylinder discrimination according to the above method, the fuel injection timing in each cylinder 2 can be set. The ECU 10 sets the timing based on the cooling water temperature (the signal output from the water temperature sensor 15) and the cranking speed etc at the time of start-up. The setting of the fuel injection timing in each cylinder 2 by the ECU 10 embodies the setting unit according to the present invention.

In the cylinder (first injection cylinder) 2 for which the time for fuel injection comes earliest (at the fuel injection start time) after the cylinder discrimination, there is a possibility that the injected fuel might not ignite or burn. For instance, in the case where the time for fuel injection is set in the neighborhood of the top dead center on the compression stroke (10-20 CA degrees before the top dead center on the compression stroke), if the cranking is started from the middle of the compression stroke in the first injection cylinder and the fuel injection start time comes in the same cycle, there is a possibility that the pressure and temperature at the end of compression might not reach a range of values suitable for combustion of fuel. Therefore, if fuel injection for the first injection cylinder (i.e. fuel injection at the fuel injection start time) is executed, there is a possibility that the injected fuel might be discharged unburned.

Figure 5:
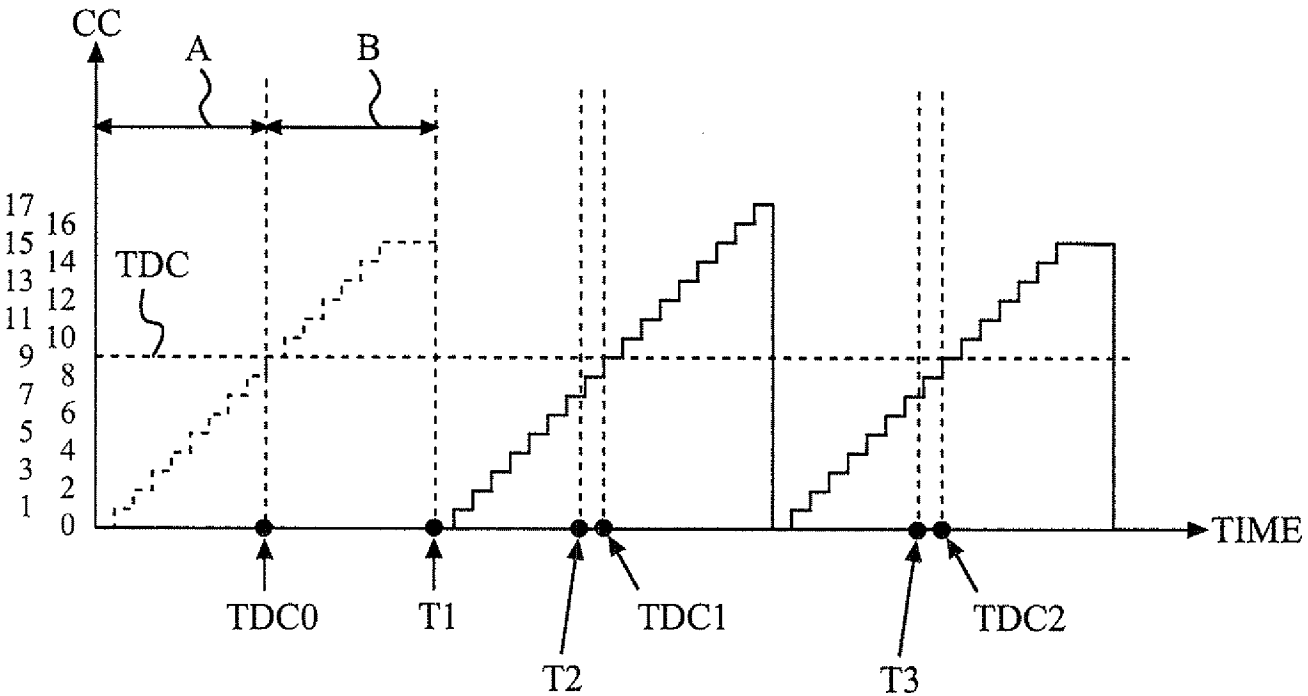
FIG. 5 shows the relationship between the time of completion of cylinder discrimination and the stopping position of the crankshaft.

FIG. 5 shows the relationship between the timing of the cylinder discrimination and the stopping position of the crankshaft 4 in the start-up of the internal combustion engine 1. In FIG. 5, "T1" represents the time of execution of the cylinder discrimination, "T2" represents the time of fuel injection in the first injection cylinder (i.e. the fuel injection start time), and "T3" represents the time of fuel injection in the second injection cylinder.

Furthermore, in FIG. 5, "TDC1" represents the top dead center on the compression stroke of the first injection cylinder, "TDC0" represents the top dead center on the compression stroke of the cylinder (which will be hereinafter referred to as the "zero cylinder") that immediately precedes the first injection cylinder in the firing order (namely, the bottom dead center on the compression stroke of the first injection cylinder), and "TDC2" represents the top dead center of the second injection cylinder.

Since in this embodiment the cylinder discrimination is executed at the time when the crankshaft 4 is at a position of 90 CA degrees before the top dead center on the compression stroke of the number one or four cylinder, the first injection cylinder mentioned in connection with FIG. 5 is either the number one cylinder or the number four cylinder.

In cases where the stopping position of the crankshaft 4 falls within the stopping range A in FIG. 5, in other words in cases where the stopping position of the crankshaft 4 is before the top dead center on the compression stroke TDC0 (i.e. the bottom dead center on the compression stroke of the first injection cylinder), the compression stroke in the first injection cylinder will progress from the beginning. Consequently, the temperature and pressure in the first injection cylinder at the end of compression are likely to reach up to the temperature range and pressure range suitable for ignition and combustion of fuel. Therefore, when fuel is injected at the fuel injection start time T2, it is very likely that the injected fuel will ignite and burn.

On the other hand, in cases where the stopping position of the crankshaft 4 falls within the stopping range B in FIG. 5, in other words in cases where the stopping position of the crankshaft 4 is after the top dead center on the compression stroke TDC0 (i.e. the bottom dead center on the compression stroke of the first injection cylinder), the compression stroke of the first injection cylinder will proceed from the middle of the stroke. Consequently, there is a possibility that the temperature and pressure in the first injection cylinder at the end of compression might not reach up to the ranges suitable for combustion of fuel. Therefore, when fuel is injected at the fuel injection start time T2, it is very likely that the injected fuel will not ignite or burn.

In view of the above, in this embodiment, if the stopping position of the crankshaft 4 falls within the stopping range A, fuel injection for the first injection cylinder (i.e. fuel injection at the fuel injection start time T2) is enabled, while if the stopping position of the crankshaft 4 falls within the stopping range B, fuel injection for the first injection cylinder is disabled.

In cases where the stopping position of the crankshaft 4 falls within the stopping range B, fuel injection may be started at the time T3 for fuel injection for the second injection cylinder. This is because the compression stroke of the second injection cylinder progress from the beginning even in cases where the stopping position of the crankshaft 4 falls within the stopping range B.

With the above-described control of fuel injection in the start-up of the internal combustion engine 1, discharge of unburned fuel from the first injection cylinder can be prevented from occurring, and an increase in exhaust emissions and an unwanted increase in fuel consumption can be avoided.

Next, a method of determining whether the stopping position of the crankshaft 4 falls within the stopping range A or the stopping range B will be described. The determination method may be, for example, specifically determining the stopping position of the crankshaft 4 and then determining whether the stopping position thus determined falls before or after the bottom dead center on the compression stroke of the first injection cylinder (i.e. the top dead center on the compression stroke of the zero cylinder) TDC0.

The method of specifically determining the stopping position of the crankshaft 4 may be, for example, counting the total number of voltage pulses (total pulse count) generated by the crank position sensor 12 during the period from the start of the cranking to the time T1 of completion of the cylinder discrimination and calculating the stopping position of the crank shaft 4 backward based on the position of the crankshaft 4 at the time T1 of completion of the cylinder discrimination and the total pulse count.

The accuracy of magnetic pickup (MPU) sensors used as the crank position sensor 12 and the cam position sensor 11 tends to be low when the rotation speed of the crankshaft is lower than a certain rotation speed (lowest rotation speed).

Figure 6:
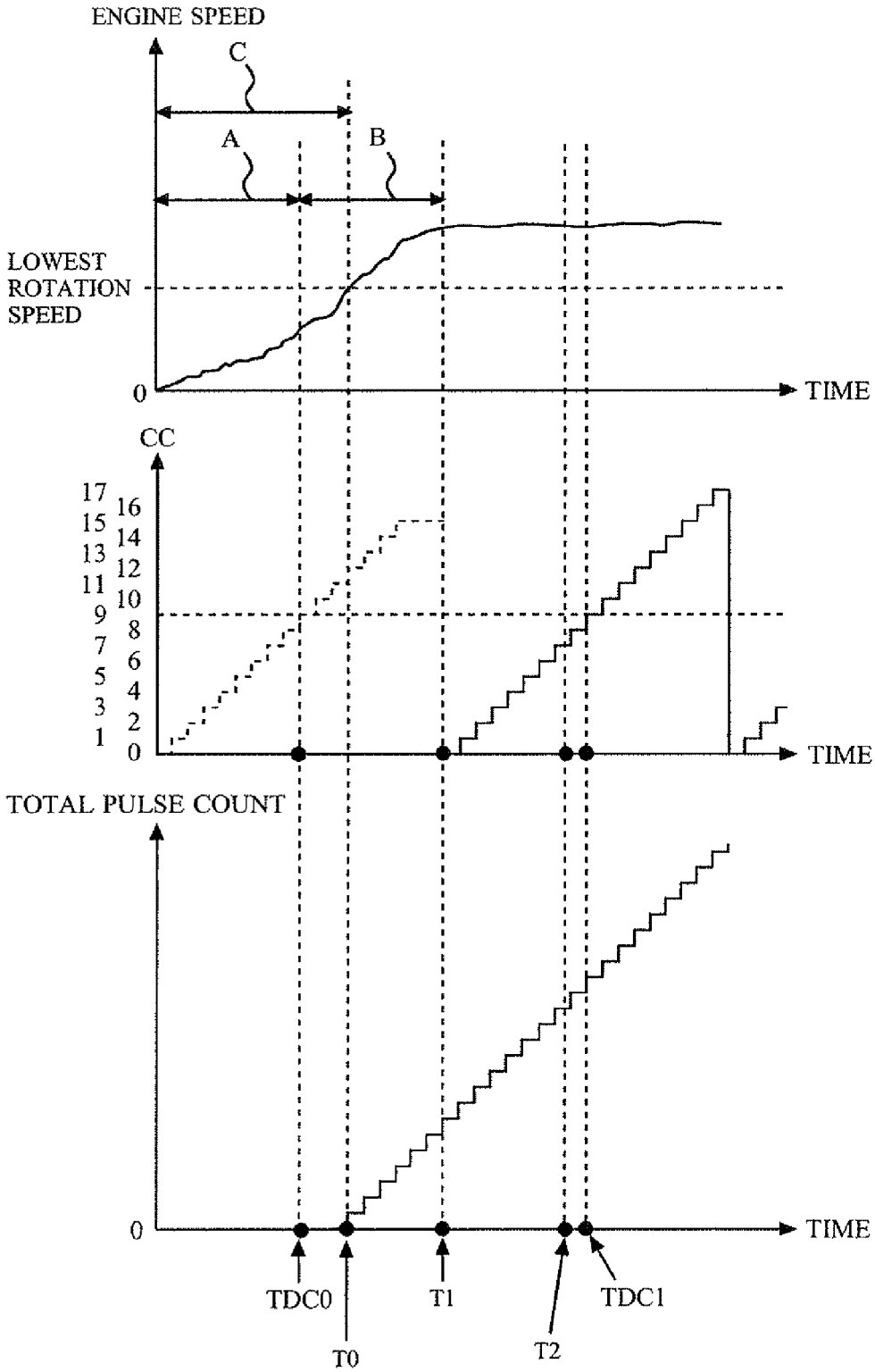
FIG. 6 shows the relationship between the engine speed and the total pulse count of the crank counter during the cranking period of the internal combustion engine.

FIG. 6 shows the relationship between the engine speed and the total number of pulses counted by the crank counter CC after the start of cranking in the internal combustion engine 1. In FIG. 6, "T0" represents the time at which the engine speed reaches the lowest rotation speed. The total pulse count is counted in a manner as if two voltage pulses were generated as the crank position sensor 12 outputs the datum signal (at the time when the tooth-free portion 124 of the rotor 121 passes near the pickup 122 of the crank position sensor 12).

During the period C (non-sensing period) since the start of cranking until time T0, the crank position sensor 12 does not output effective voltage pulses. Therefore, the total pulse count is kept to zero during the non-sensing period C. In consequence, it is impossible to determine the stopping position of the crankshaft 4 based on the total pulse count.

Therefore, the start-up control system for an internal combustion engine according to this embodiment is configured to estimate the amount of rotation (not-sensed rotation amount) of the crankshaft 4 during the non-sensing period C and to correct the total pulse count based on the estimated amount. In this embodiment, it is assumed that the not-sensed rotation amount is obtained in advance by an adaptation process based on an experiment etc.

Figure 7:
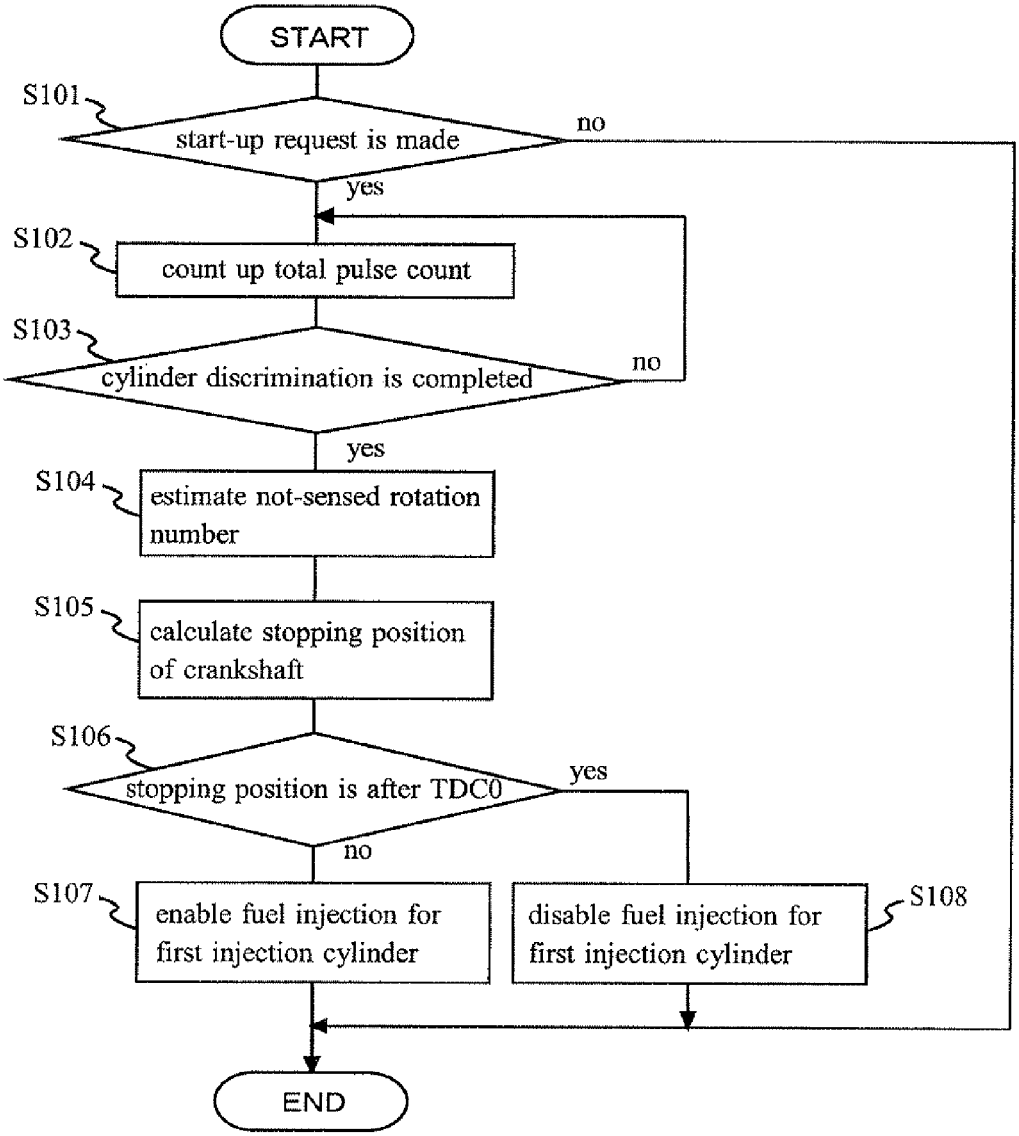
FIG. 7 is a flow chart of a control routine executed at the time of start-up of the internal combustion engine in a first embodiment.

In the following, the procedure of starting fuel injection at the time of start-up of the internal combustion engine 1 will be described with reference to FIG. 7. FIG. 7 shows a control routine executed at the time of start-up the internal combustion engine 1. This control routine is stored in advance in a ROM or the like in the ECU 10 and executed by the ECU 10 when a request for start-up of the internal combustion engine 1 is made.

In the control routine shown in FIG. 7, the ECU 10 firstly executes the process of step S101. In step S101, the ECU 10 determines whether or not a start-up request is made. For example, the ECU 10 determines that a start-up request is made when the ignition switch is turned from off to on or the starter switch is turned from off to on. In the case of a hybrid vehicle provided with the internal combustion engine 1 and an electric motor as a motor of the vehicle, the ECU 10 determines that a start-up request is made when the condition for driving the vehicle by the internal combustion engine 1 is met or when the condition for driving a generator by the internal combustion engine 1 is met.

If the determination in step S101 is negative, the ECU 10 terminates the execution of this routine. On the other hand, if the determination in step S101 is affirmative, the ECU 10 proceeds to step S102. In step S102, the ECU 10 counts up the number of voltage pulses generated by the crank position sensor 12 (the total pulse count). The ECU 10 is configured to add two to the count when the crank position sensor 12 detects the datum signal. The execution of the process of step S102 by the ECU 10 embodies the counting unit according to the present invention.

In step S103, the ECU 10 determines whether or not the cylinder discrimination has been completed. If the determination in step S103 is negative, the ECU 10 returns to step S102. On the other hand, if the determination in step S103 is affirmative, the ECU 10 proceeds to step S104.

In step S104, the ECU 10 estimates the not-sensed rotation amount. In the case of this embodiment, the estimated value of the not-sensed rotation amount is stored in advance in a ROM or the like, and the not-sensed rotation amount stored in the ROM or the like is read in step S104. The execution of the process of step S104 by the ECU 10 embodies the estimation unit according to the present invention.

In step S105, the ECU 10 calculates the stopping position of the crankshaft 4 based on the total pulse count at the time of completion of the cylinder discrimination and the estimated value of the not-sensed rotation amount.

In step S106, the ECU 10 determines whether or not the stopping position of the crankshaft 4 calculated in step S105 is after the top dead center on the compression stroke of the zero cylinder (i.e. the bottom dead center on the compression stroke of the first injection cylinder) TDC0.

If the determination in step S106 is negative, injected fuel is easy to ignite and burn, because the negative determination suggests that the compression stroke in the first injection cylinder starts from the beginning of the stroke. Therefore, the ECU 10 proceeds to step S107, where it enables fuel injection for the first injection cylinder. In other words, the ECU 10 enables fuel injection at the fuel injection start time.

On the other hand, if the determination in step S106 is affirmative, injected fuel is hard to ignite and burn, because the affirmative determination suggests that the compression stroke in the first injection cylinder starts from the middle of the stroke. Therefore, the ECU 10 proceeds to step S108, where it disables fuel injection for the first injection cylinder. In other words, the ECU 10 disables fuel injection at the fuel injection start time. Thus, fuel injected into the first injection cylinder can be prevented from discharged unburned. Consequently, an increase in exhaust emissions and an increase in fuel consumption can be avoided.

The execution of the process of steps S105 through S108 embodies the control unit according to the present invention.

According to the above-described embodiment, a situation in which fuel injection is started under a condition in which injected fuel is hard to burn can be avoided at the time of start-up of the internal combustion engine 1. In other words, at the time of start-up of the internal combustion engine 1, fuel injection can be started under a condition in which injected fuel can ignite and burn. In consequence, it is possible to start fuel injection while preventing an increase in exhaust emissions and an increase in fuel consumption at the time of start-up of the internal combustion engine 1.

In this embodiment, a case in which the compression stroke beginning position is set to the bottom dead center on the compression stroke of the first injection cylinder has been described. However, the compression stroke beginning position may be set to the position at which the intake valve 7 of the first injection cylinder is closed. The temperature and the pressure at the compression end of the first injection cylinder vary with the ambient air temperature at the time when the cranking is started. Therefore, the compression stroke beginning position may be set in relation to the ambient air temperature at the time when the cranking is started. For example, the compression stroke beginning position may be more retarded when the ambient air temperature is high than when the ambient air temperature is low. If the compression stroke beginning position is set in this way, the chances of enabling fuel injection at the fuel injection start time can be increased. In consequence, the time taken to start the internal combustion engine 1 can be reduced as much as possible.

Embodiment 2

Figure 8:
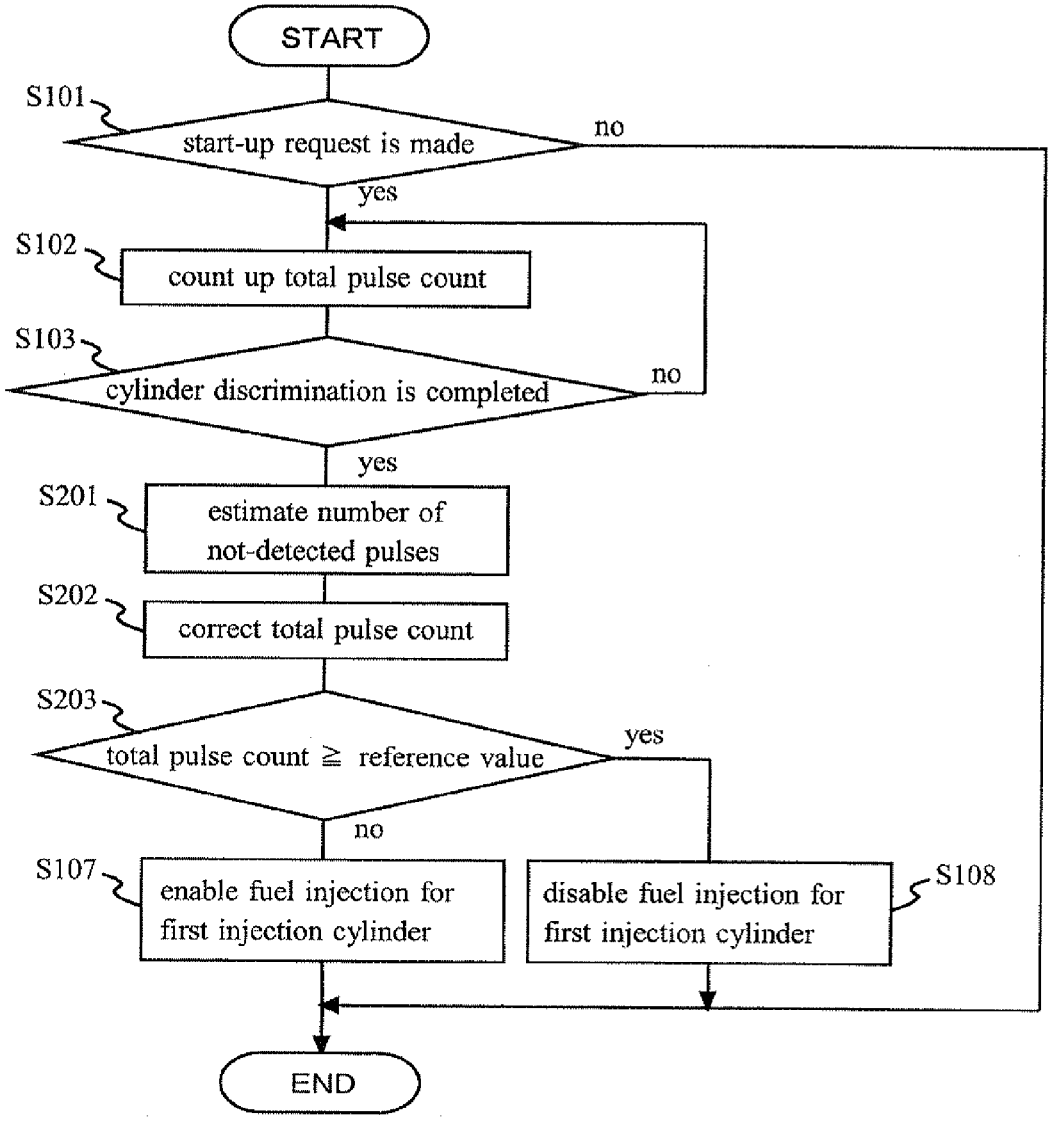
FIG. 8 is a flow chart of a control routine executed at the time of start-up of the internal combustion engine in a second embodiment.

Next, a second embodiment of the present invention will be described with reference to FIG. 8. Here, features different from those in the above-described first embodiment will be described, and like features will not be described.

In the above-described first embodiment, there has been described a case in which the stopping position of the crankshaft 4 is specifically determined, and then it is determined whether fuel injection for the first injection cylinder (i.e. fuel injection at the fuel injection start time) is to be enabled or disabled.

In this embodiment, there will be described a case in which the total pulse count is corrected based on the not-sensed rotation amount, and fuel injection for the first injection cylinder is enabled on condition that the total pulse count after correction (=total number of pulses) is not smaller than a predetermined reference value.

The aforementioned predetermined reference value is the total number of pulses (i.e. the number of pulses that should be generated during the period from TDC0 to T1 in FIG. 6) in the case where cranking is started from the compression stroke beginning position (i.e. in the case where the stopping position of the crankshaft 4 is at the compression stroke beginning position) or a value obtained by adding a safety margin to the total number of pulses.

In the following, fuel injection control in the start-up of the internal combustion engine 1 will be described with reference to FIG. 8. FIG. 8 shows a control routine executed at the time of start-up of the internal combustion engine 1. In FIG. 8, the processes same as those in the control routine in the above-described first embodiment (see FIG. 7) are denoted by the same symbols.

If the determination in step S103 is affirmative, the ECU 10 executes the process of steps S201 to S203 in place of the process of S104 to S106. First in step S201, the ECU 10 estimates the number of voltage pulses that should be generated during the non-sensing period C (which will be hereinafter referred to as "the number of not-detected pulses"). The number of not-detected pulses expresses the not-sensed rotation amount in terms of the number of generated voltage pulses. The number of not-detected pulses is obtained in advance by an adaptation process based on an experiment etc.

Then, the ECU 10 proceeds to step S202, where it corrects the total pulse count at the time of completion of the cylinder discrimination using the number of not-detected pulses obtained in the above step S201. Specifically, the ECU 10 adds the number of not-detected pulses obtained in the above step S201 to the total pulse count at the time of completion of the cylinder discrimination.

In step S203, the ECU 10 determines whether or not the total pulse count after correction made in the above step S202 (=the total number of pulses) is equal to or larger than the reference value. As described above, the reference value is the total number of pulses in the case where the stopping position of the crankshaft 4 is at the compression stroke beginning position or a value obtained by adding a safety margin to this total number of pulses. The reference value may be changed in accordance with the compression stroke beginning position.

If the determination in step S203 is affirmative, injected fuel is easy to ignite and burn, because the affirmative determination suggests that the compression stroke in the first injection cylinder starts from the beginning of the stroke. Then, therefore, the ECU 10 proceeds to step S107, where it enables fuel injection for the first injection cylinder.

On the other hand, if the determination in step S203 is negative, injected fuel is hard to ignite and burn, because the negative determination suggests that the compression stroke in the first injection cylinder starts from the middle of the stroke. Then, therefore, the ECU 10 proceeds to step S108, where it disables fuel injection for the first injection cylinder.

According to the embodiment described above, the advantageous effects same as those in the first embodiment can be achieved.

Embodiment 3

Next, a third embodiment according to the present invention will be described with reference to FIG. 9. Here, features different from those in the above-described first and second embodiments will be described, and like features will not be described.

In the first and second embodiments described above, cases in which a predetermined value is used as the not-sensed rotation amount or the number of not-detected pulses have been described. In this embodiment, there will be described a case in which the not-sensed rotation amount and the number of not-detected pulses are estimated in relation to the environment in which the internal combustion engine 1 is used and the charge state of the battery 14.

The degree of increase in the rotation of the crankshaft 4 after the start of cranking varies depending on the magnitude of friction in the internal combustion engine 1 and the output of the battery 14. For example, if the friction in the internal combustion engine becomes high, the degree of increase in the rotation of the crankshaft 4 will become small. Consequently, the not-sensed rotation amount and the number of not-detected pulses will become large. The friction in the internal combustion engine 1 tends to be large when lubricant oil has high viscosity, and the viscosity of lubricant oil tends to be higher when the ambient air temperature is low than when the ambient air temperature is high. Therefore, the not-sensed rotation amount and the number of not-detected pulses will be larger when the ambient air temperature is low than when the ambient air temperature is high.

If the driving force of the starter motor 13 becomes small, the degree of increase in the rotation of the crankshaft 4 will become small. Consequently, the not-sensed rotation amount and the number of not-detected pulses will become large. The driving force of the starter motor 13 correlates with the output of the battery 14. The output of the battery 14 tends to be low when the SOC is low and/or the ambient air temperature is low. Therefore, the not-sensed rotation amount and the number of not-detected pulses will be larger when the SOC of the battery 14 is low and/or the ambient air temperature is low than when the SOC is high and/or the ambient air temperature is low.

In view of the above, in this embodiment, a predetermined not-sensed rotation amount or a predetermined number of not-detected pulses (which will be hereinafter referred to as the "standard value") is corrected in relation to the ambient air temperature and the SOC of the battery 14. The standard value is the not-sensed rotation amount or the number of not-detected pulses at the time when the ambient air temperature is in a normal temperature range and the SOC of the battery 14 is not lower than a specific value.

In the following, a procedure of correcting the standard value in this embodiment will be described with reference to FIG. 9. FIG. 9 is a flow chart of a control routine executed by the ECU 10 when estimating the not-sensed rotation amount or the number of not-detected pulses. This control routine is a routine that is handled as an interrupt triggered by the execution of step S104 in FIG. 7 or step S201 in FIG. 8.

Figure 9:
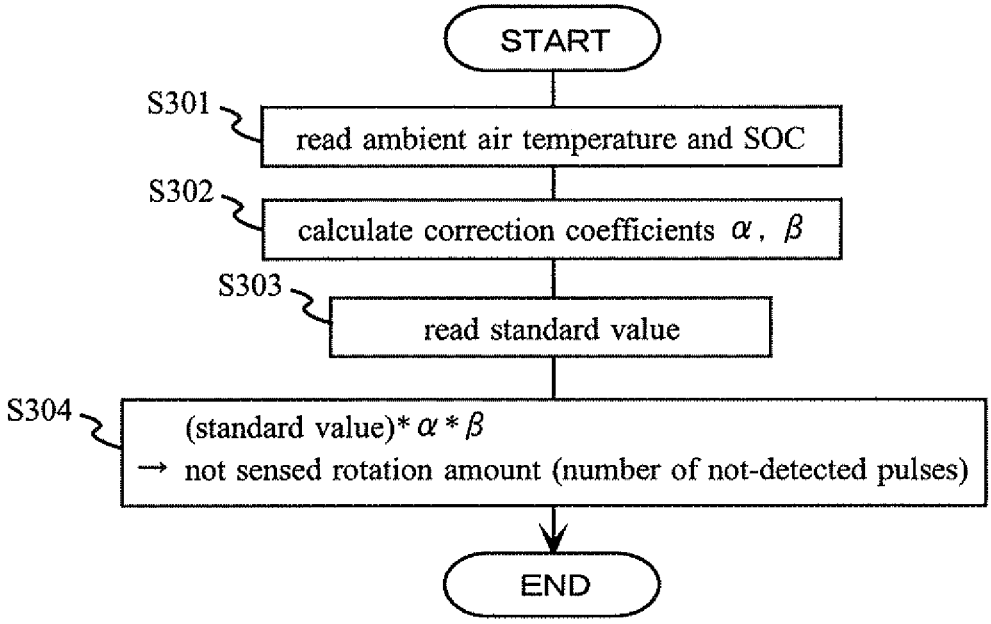
FIG. 9 is a flow chart of a control routine that is handled as an interrupt at the time of estimation of an not-sensed rotation amount or the number of not-detected pulses.

In the control routine shown in FIG. 9, the ECU 10 firstly executes the process of step S301. Specifically, the ECU 10 reads the signal output from the ambient air temperature sensor 16 (the ambient air temperature) and the SOC of the battery 14.

In step S302, the ECU 10 calculates a correction coefficient $\alpha$ that depends on the ambient air temperature and a correction coefficient $\beta$ that depends on the SOC. The relationship between the correction coefficient $\alpha$ and the ambient air temperature and the relationship between the correction coefficient $\beta$ and the SOC may be obtained as maps in advance by adaptation process based on an experiment etc. The correction coefficient $\alpha$ is set in this process in such a way as to have a value of 1 (one) when the ambient air temperature falls within the normal temperature range and to have a value smaller than 1 (one) when the ambient air temperature falls below the normal temperature range. The correction coefficient $\beta$ is set in this process in such a way as to have a value of 1 (one) when the SOC is higher than the specific value and to have a value smaller than 1 (one) when the SOC is lower than the specific value.

In step S303, the ECU 10 reads a standard value stored in advance in a ROM or the like. Then in step S304, the ECU 10 multiplies the standard value read in the above step S303 by the correction coefficients $\alpha$ and $\beta$ obtained in the above step S302 to determine the not-sensed rotation amount or the number of not-detected pulses.

By determining the not-sensed rotation amount or the number of not-detected pulses in the above-described manner, a determination can be made with improved accuracy as to whether or not the stopping position of the crankshaft 4 is after (i.e. retarded relative to) the compression stroke beginning position. Specifically, even if the environment in which the internal combustion engine 1 is used or the state of charge of the battery 14 changes, a determination as to whether or not injected fuel can burn in the first injection cylinder can be made with improved accuracy.

Therefore, a situation in which fuel injection is started under a condition in which injected fuel is hard to burn can be avoided more reliably in the start-up of the internal combustion engine 1. In consequence, fuel injection can be started while preventing an increase in exhaust emissions and an increase in fuel consumption at the time of start-up of the internal combustion engine 1 more reliably.

In this embodiment, a case in which the not-sensed rotation amount or the number of not-detected pulses are estimated by correcting the standard value of the not-sensed rotation amount or the number of not-detected pulses in relation to the ambient air temperature and the SOC. However, the relationship between the not-sensed rotation amount or the number of not-detected pulses and the ambient air temperature and the SOC may be prepared in advance as a map. In this case, the ECU 10 may calculate the not-sensed rotation amount or the number of not-detected pulses by substituting the output signal of the ambient air temperature sensor 16 and the SOC of the battery 14 into the map.

Instead of correcting the standard value of the not-sensed rotation amount or the number of not-detected pulses, the compression stroke beginning position or the reference value that used as a criterion in determining whether fuel injection for the first injection cylinder is to be enabled or disabled may be corrected in relation to the ambient air temperature and/or the SOC. In this case, the compression stroke beginning position may be corrected in such a way that it is more retarded when the ambient air temperature is low than when the ambient air temperature is high and more retarded when the SOC is low than when the SOC is high. On the other hand, the reference value may be corrected in such a way that it is smaller when the ambient air temperature is low than when the ambient air temperature is high and smaller when the SOC is low than when the SOC is high.

The above-described various types of correction may be made in relation not to the ambient air temperature and the SOC but to the rotation speed (degree of increase in the rotation) of the crankshaft 4 after the rotation speed of the crankshaft 4 becomes equal to or higher than the lowest rotation speed. After the rotation speed of the crankshaft 4 has become equal to or higher than the lowest rotation speed, the degree of increase in the rotation correlates with the degree of increase in the rotation of the crankshaft 4 during the non-sensing period C. Therefore, the not-sensed rotation amount or the number of not-detected pulses may be corrected in such a way that the not-sensed rotation amount or the number of not-detected pulses is made larger when the degree of increase in the rotation after the rotation speed of the crankshaft 4 becomes equal to or higher than lowest rotation speed is low than when it is high.

Embodiment 4

Next, a fourth embodiment of the present invention will be described with reference to FIG. 10. Here, features different from those in the above-described third embodiment will be described, and like features will not be described.

In the above-described third embodiment, a case in which the not-sensed rotation amount or the number of not-detected pulses is estimated by correcting a predetermined standard value in relation to the ambient air temperature and the SOC. In this embodiment, there will be described a case in which the not-sensed rotation amount or the number of not-detected pulses is estimated in relation to the change in the voltage and/or current of the battery 14 over time after the start of cranking of the internal combustion engine 1.

Figure 10:
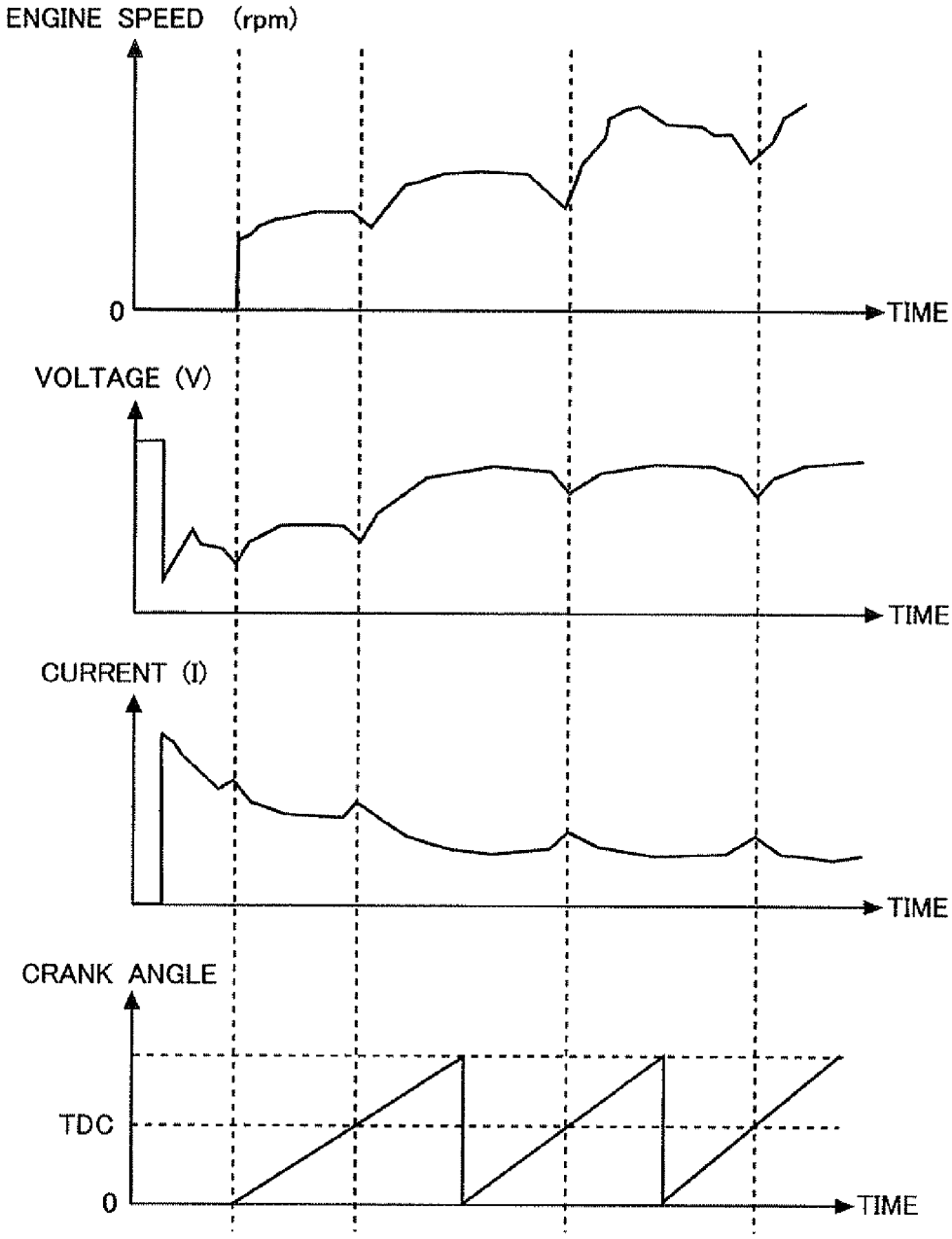
FIG. 10 shows the change in the voltage and current of a battery with time during the cranking of the internal combustion engine.

FIG. 10 shows the change in the engine speed, the battery voltage, the battery current and the rotational position of the crankshaft with time during the cranking of the internal combustion engine 1. As shown in FIG. 10, the voltage of the battery 14 rises steeply at the time when the crankshaft passes the top dead center on the compression stroke (TDC) of every cylinder 2. In contrast, the current of the battery 14 falls steeply at the tine when the crankshaft passes the top dead center on the compression stroke (TDC) of every cylinder 2.

Therefore, it is possible to determine whether or not the crankshaft 4 passes the top dead center on the compression stroke of the zero cylinder (i.e. the cylinder that immediately precedes the first injection cylinder in the firing order) (or the bottom dead center on the compression stroke of the first injection cylinder) during the non-sensing period by monitoring the voltage or current of the battery 14 during the non-sensing period. Thus, it is possible to determine whether or not the stopping position of the crankshaft 4 is before the top dead center on the compression stroke of the zero cylinder.

In view of the above, if the ECU 10 determines that the crankshaft 4 has passed the top dead center on the compression stroke of the zero cylinder during the non-sensing period, the ECU 10 may give an estimated value of the not-sensed rotation amount or the number of not-detected pulses larger than a predetermined value. On the other hand, if the ECU 10 determines that the crankshaft 4 has not passed the top dead center on the compression stroke of the zero cylinder during the non-sensing period, the ECU 10 may give an estimated value of the not-sensed rotation amount or the number of not-detected pulses smaller than the predetermined value. The predetermined value mentioned above is the not-sensed rotation amount or the number of not-detected pulses in the case where the stopping position of the crankshaft 4 is at the top dead center on the compression stroke of the zero cylinder.

By estimating the not-sensed rotation amount or the number of not-detected pulses in the above way, the advantageous effects same as those in the first to third embodiments can be achieved.

The configurations of the crank position sensor 12 and the cam position sensor 11 in the first to fourth embodiments described in the foregoing are not limited to those illustrated in FIGS. 2 and 3. For instance, the intervals of the teeth 123 provided on the rotor 123 of the crank position sensor 12 are not limited to 10 CA degrees, and the width of the tooth-free portion 124 is not limited to 30 CA degrees. The number of teeth provided on the rotor 111 of the cam position sensor 11 may be one. Furthermore, a signal output from a sensor other than the cam position sensor 11 may be used in cylinder discrimination.

The same advantageous effects will also be achieved even if the internal combustion engines 1 in the first to fourth embodiments described in the foregoing are spark-ignition internal combustion engines equipped with fuel injection valves injecting fuel into the cylinders.

DESCRIPTION OF THE REFERENCE SIGNS

1: internal combustion engine
2: cylinder
3: fuel injection valve
4: crankshaft
5: connecting rod
6: piston
7: intake valve
8: intake camshaft
10: ECU
11: cam position sensor
12: crank position sensor
13: starter motor
14: battery
15: water temperature sensor
16: ambient air temperature
111: rotor
112: pickup
113: tooth
114: tooth

115: tooth
116. tooth-free portion
117. tooth-free portion
118. tooth-free portion
121: rotor
122: pickup
123: tooth
124. tooth-free portion

The invention claimed is:

1. A start-up control system for an internal combustion engine comprising:

a cranking mechanism that cranks the internal combustion engine at the time of start-up of the internal combustion engine;

a setting unit for determining the rotational position of a crankshaft while the internal combustion engine is cranked by said cranking mechanism and for setting a fuel injection start time based on a result of the determination;

a counting unit for counting the number of pulses output from a crank position sensor since the start of cranking of the internal combustion engine by said cranking mechanism;

an estimation unit for estimating the amount of rotation of the crankshaft in a period since the start of cranking of the internal combustion engine until the crank position sensor outputs an effective pulse signal; and a control unit that enables injection of fuel at the fuel injection start time set by said setting unit on condition that the stopping position of the crankshaft determined by the count counted by said counting unit and the value estimated by the estimation unit is before a predetermined position.

2. A start-up control system for an internal combustion engine according to claim 1, wherein said control unit corrects the count counted by said counting unit based on the value estimated by said estimation unit, and if the count after correction is not smaller than a predetermined reference value, it is determined that the stopping position of the crankshaft is before the predetermined position.

3. A start-up control system for an internal combustion engine according to claim 1, wherein the estimation unit corrects the estimated value in relation to the ambient air temperature.

4. A start-up control system for an internal combustion engine according to claim 1, wherein the cranking mechanism is a mechanism that cranks the internal combustion engine utilizing output of a battery, and the estimation unit corrects the estimated value in relation to the state of charge of the battery.

5. A start-up control system for an internal combustion engine according to claim 1, wherein the control unit corrects said predetermined position in relation to the ambient air temperature.

6. A start-up control system for an internal combustion engine according to claim 2, wherein the cranking mechanism is a mechanism that cranks the internal combustion engine utilizing output of a battery, and the control unit corrects the reference value in relation to the state of charge of the battery.

7. A start-up control system for an internal combustion engine according to claim 1, wherein the cranking mechanism is a mechanism that cranks the internal combustion engine utilizing output of a battery, and the estimation unit estimates the amount of rotation of the crankshaft in a period since the start of cranking of the internal combustion engine until the crank position sensor outputs an effective pulse signal, based on the value of voltage and/or the value of current of the battery during said period.

8. A start-up control system for an internal combustion engine according to claim 2, wherein the estimation unit corrects the estimated value in relation to the ambient air temperature.

9. A start-up control system for an internal combustion engine according to claim 2, wherein the control unit corrects said predetermined position in relation to the ambient air temperature.

10. A start-up control system for an internal combustion engine according to claim 2, wherein the cranking mechanism is a mechanism that cranks the internal combustion engine utilizing output of a battery, and the estimation unit corrects the estimated value in relation to the state of charge of the battery.

11. A start-up control system for an internal combustion engine according to claim 2, wherein the cranking mechanism is a mechanism that cranks the internal combustion engine utilizing output of a battery, and the estimation unit estimates the amount of rotation of the crankshaft in a period since the start of cranking of the internal combustion engine until the crank position sensor outputs an effective pulse signal, based on the value of voltage and/or the value of current of the battery during said period.

* * * * *